US007677232B2

(12) United States Patent
Rosenblum et al.

(10) Patent No.: US 7,677,232 B2
(45) Date of Patent: Mar. 16, 2010

(54) MULTIPLE PROJECTILE-FIRING TOY GUN WITH SEPARATE TARGET-LAUNCHING MECHANISM

(75) Inventors: Brian Rosenblum, Sherman Oaks, CA (US); Dominic Laurienzo, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 547 days.

(21) Appl. No.: 11/497,555

(22) Filed: Jul. 31, 2006

(65) Prior Publication Data

US 2008/0022988 A1 Jan. 31, 2008

(51) Int. Cl.
*F41B 7/08* (2006.01)

(52) U.S. Cl. ..... 124/16; 446/38; 446/39

(58) Field of Classification Search ..... 124/16, 124/20.1, 20.2, 20.3, 27; 446/38, 39, 45
See application file for complete search history.

(56) References Cited

U.S. PATENT DOCUMENTS

| | | | | |
|---|---|---|---|---|
| 1,571,643 | A * | 2/1926 | Renick | 124/21 |
| 2,237,678 | A * | 4/1941 | Lohr et al. | 124/66 |
| 3,968,784 | A | 7/1976 | Miller | |
| 5,156,137 | A | 10/1992 | Clayton | |
| 5,184,756 | A | 2/1993 | Amron | |
| 5,213,089 | A | 5/1993 | DeLuca | |
| 5,261,852 | A | 11/1993 | Ejima | |
| D346,837 | S | 5/1994 | Sun | |
| 5,373,832 | A | 12/1994 | D'Andrade | |
| D361,105 | S | 8/1995 | Griffin | |
| 5,531,210 | A | 7/1996 | Meiser et al. | |
| 5,564,964 | A | 10/1996 | Chin-Chien | |
| 5,645,038 | A | 7/1997 | Luk | |
| 5,797,385 | A | 8/1998 | Thai | |
| 5,901,693 | A | 5/1999 | Smith | |
| 5,924,413 | A | 7/1999 | Johnson et al. | |
| 5,988,152 | A | 11/1999 | Halter et al. | |
| 6,048,280 | A | 4/2000 | Palmer et al. | |
| 6,076,513 | A | 6/2000 | Doherty et al. | |
| 6,364,162 | B1 | 4/2002 | Johnson et al. | |
| 6,428,384 | B1 | 8/2002 | Su | |

* cited by examiner

*Primary Examiner*—John Ricci
(74) *Attorney, Agent, or Firm*—Tope-McKay & Associates

(57) ABSTRACT

The present invention relates to a toy gun that is capable of firing multiple projectiles using an internal rotating firing assembly. The toy gun further provides a separate target launching mechanism to launch a target object into the air for use as a target when firing the projectiles. A plurality of projectiles is spring-loaded into a cartridge on a barrel of the gun, where they can then be sequentially fired from the gun in rapid succession by pulling a projectile trigger. The projectile trigger activates a rotating firing control disc inside the barrel of the gun to fire at least one projectile every time the projectile trigger is pulled. Additionally, the toy gun is capable of launching a flying object with a separate mechanism for use as a target when firing the projectiles.

16 Claims, 5 Drawing Sheets

MULTIPLE PROJECTILE-FIRING TOY GUN WITH SEPARATE TARGET-LAUNCHING MECHANISM

BACKGROUND OF THE INVENTION (1) Technical Field

The present invention relates to the field of toy simulated weapons. More specifically, the present invention pertains to a toy gun capable of firing multiple projectiles in rapid succession using a rotatable firing assembly. The toy gun also has the capability of separately launching a flying object to act as a target when firing the projectiles.

(2) Background

Toy guns that fire multiple projectiles are well-known in the art. Numerous references teach mechanisms to fire a plurality of projectiles using pressurized toy guns or magazine-loading toy guns that simulate the function of real weapons. However, many existing toy guns that fire multiple-projectiles have complicated parts and electronics that are susceptible to failure when exposed to heavy use and stress, such as that typically applied by children.

Additionally, existing toy guns are directed simply to firing a projectile with the assumption that the user already has a target. However, children may often be without a playmate or a useful target with which to fire a projectile at, and adults are often weary of children playing with projectile-firing toys if a kid-safe target does not exist.

Therefore, what is needed is a multiple projectile-firing toy gun that is durable and easy to use, and free of complex electronics. Additionally, what is desired is a toy gun that provides a target for children that is both flu, safe, and challenging for a child to use.

SUMMARY OF THE INVENTION

The present invention relates to a toy gun that is capable of firing multiple projectiles using an internal rotating firing assembly. The toy gun further provides a separate target launching mechanism to launch a target object into the air for use as a target when firing the projectiles. A plurality of projectiles is spring-loaded into a cartridge on a barrel of the gun, where they can then be sequentially fired from the gun in rapid succession by pulling a projectile trigger. The projectile trigger activates a rotating firing control disc inside the barrel of the gun to fire at least one projectile every time the projectile trigger is pulled.

In one aspect of the present invention, a multiple projectile-firing toy gun comprises a housing including a front barrel portion and a rear handle portion; and a firing assembly disposed within the front barrel portion of the housing to fire at least one of a plurality of projectiles upon the actuation of a projectile trigger, wherein the firing assembly further comprises a rotatable firing control disc for firing at least one of the plurality of projectiles.

In another aspect of the present invention, a cartridge is attached with the front barrel portion for receiving a plurality of projectiles.

In still another aspect of the present invention, the cartridge further comprises a plurality of individual barrels, each barrel formed to contain an individual projectile.

In yet another aspect of the present invention, the number of barrels is 6.

In a further aspect of the present invention, the projectile is a dart with an elongated body and a suction cup-shaped rubber tip.

In a still further aspect of the present invention, the rear handle portion of the housing further comprises a handle for gripping the toy gun.

In a yet further aspect of the present invention, the housing further comprises a sight for aiming of the projectiles before actuation of the trigger.

In one aspect of the present invention, the toy gun further comprises a target-launching mechanism for launching a target object that acts as a moving target during the firing of the projectiles from the gun.

In another aspect of the present invention, the target-launching mechanism further comprises a target-launching trigger which actuates a target launcher to launch the target object into the air.

In still another aspect of the present invention, the target object is a toy propeller with a hub and a plurality of blades radially extending from the hub, and wherein the hub is adapted to the target launcher.

In yet another aspect of the present invention, the target launching mechanism further comprises a gear assembly and a gear rack, and wherein the gear assembly is in driving connection with the target launcher, and wherein the gear rack is in driving connection with the gear assembly.

In a further aspect of the present invention, the target-launching trigger further comprises a hand-operated slide grip in driving connection with the gear rack.

In a yet further aspect of the present invention, the firing assembly further comprises a spring-loaded firing member for launching the projectile out of the barrel.

In one aspect of the present invention, the firing assembly further comprises a plurality of pivoting projectile locks for locking each projectile as it is loaded into a specified barrel, and wherein the pivoting projectile locks restrict the spring-loaded firing mechanism from engaging the projectile until the actuation of the projectile trigger.

In another aspect of the present invention, the firing control disc further comprises a firing release tab for pivoting the pivoting projectile lock to release the projectile and launch the spring-loaded firing member.

In yet another aspect of the present invention, the firing assembly further comprises a firing control lock for interacting with a groove in the firing control disc to permit only one projectile to be fired upon each actuation of the projectile trigger.

In still another aspect of the present invention, the firing control disc contains a plurality of grooves that corresponds to the number of barrels in the cartridge.

In a further aspect of the present invention, the housing further comprises a storage section for storage of projectiles and target objects.

In a yet further aspect of the present invention, the storage section is a pair of wing-shaped protrusions extending from the housing, and wherein the wing-shaped protrusions include a mounting structure to hold a plurality of projectiles and target objects.

In a still further aspect of the present invention, the storage section is capable of holding at least 6 projectiles and 2 target objects.

Finally, a method for forming and attaching the various parts is described below.

BRIEF DESCRIPTION OF THE DRAWINGS

The objects, features and advantages of the present invention will be apparent from the following detailed descriptions of the preferred aspect of the invention in conjunction with reference to the following drawings, where.

DETAILED DESCRIPTION

Figure 1:
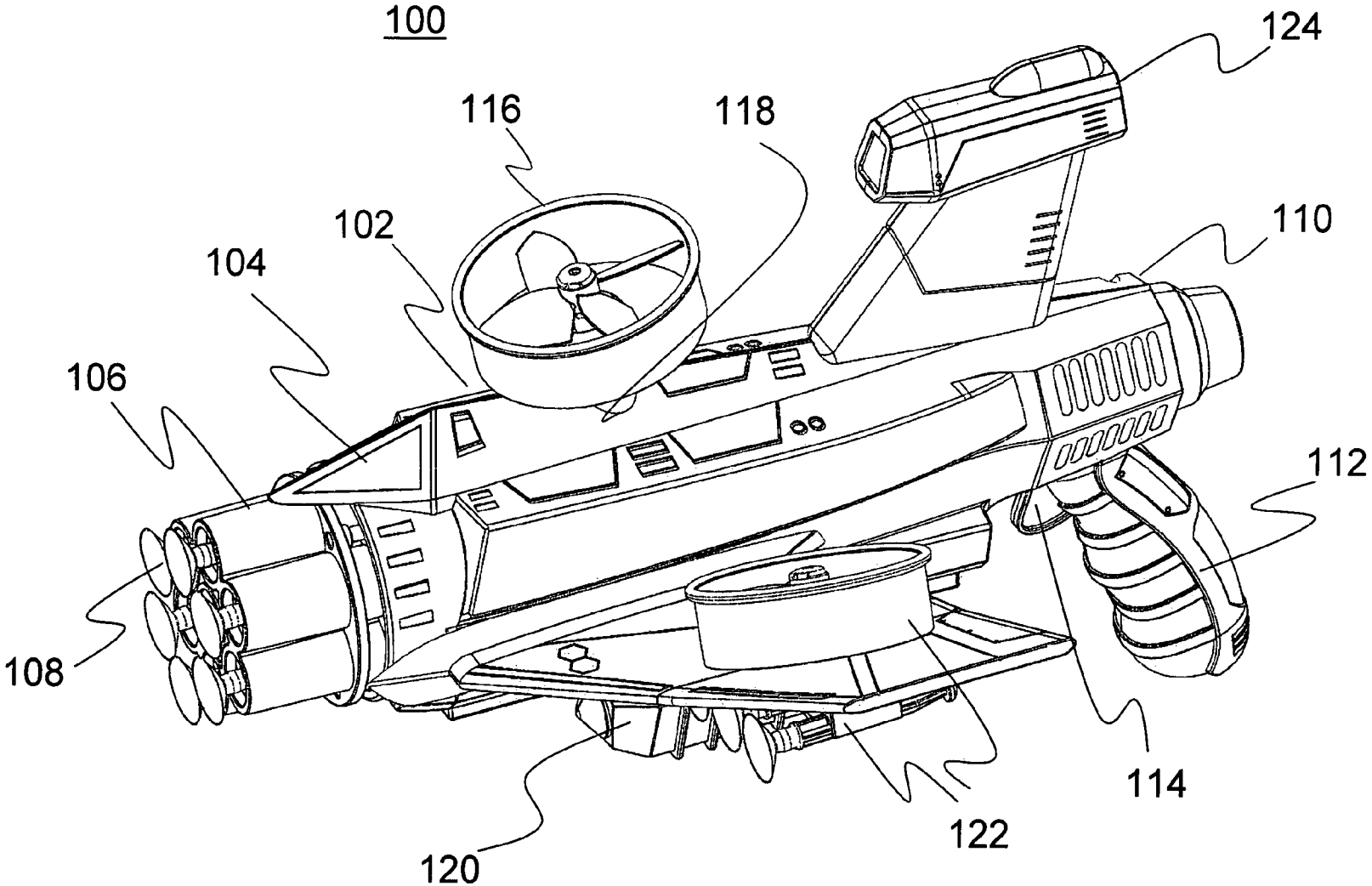
FIG. 1 is a perspective-view illustration of a multiple projectile-firing toy gun with separate target-launching mechanism depicting a housing with a front barrel portion and a rear handle portion along with a handle, gun sight, and barrel.

The present invention provides a system and a method that overcomes the aforementioned limitations and fills the aforementioned needs by providing a toy gun that is capable of firing multiple projectiles using an internal rotating firing assembly. The toy gun further provides a separate target launching mechanism to launch a target object into the air for use as a target when firing the projectiles. A plurality of projectiles is spring-loaded into a cartridge on a barrel of the gun, where they can then be sequentially fired from the gun in rapid succession by pulling a projectile trigger. The projectile trigger activates a rotating firing control disc inside the barrel of the gun to fire at least one projectile every time the projectile trigger is pulled. Additionally, the toy gun is capable of launching a flying object with a separate mechanism for use as a target when firing the projectiles.

The following description, taken in conjunction with the referenced drawings, is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore it should be noted that, unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

The present invention is a multiple projectile-firing toy gun combined with a separately activated target-launching mechanism for launching a target to use when firing the projectiles. In one aspect, as illustrated in FIG. 1, the toy gun 100 includes a housing 102 with a front barrel portion 104 that includes a cartridge 106 for loading a plurality of projectiles 108. In direct connection with the cartridge 106 and disposed within the housing 102 is a firing assembly (not pictured) that locks the projectiles 108 into the cartridge 106 until they are fired. The housing 102 further contains a rear handle portion 110 that includes a handle 112 for holding the toy gun 100 and a projectile trigger 114 used to activate the firing assembly and launch the projectiles 108.

The separate target-launching mechanism is mostly disposed within the housing 102 and uses a gear assembly (not pictured) to rotate and launch a target object 116 into the air. The target object 116 is detachably attached to a target launcher 118 at any suitable location for launching the target object 116 into the air, a non-limiting example including on an upper portion of the housing 102. The target object 116 is launched by actuation of a target-launching trigger 120 that is separate from the projectile trigger 114.

In one aspect of the present invention, the toy gun includes additional features such as storage areas 122 for keeping additional projectiles and target objects, and a sight 124 for aiming the toy gun at a target.

Figure 2:
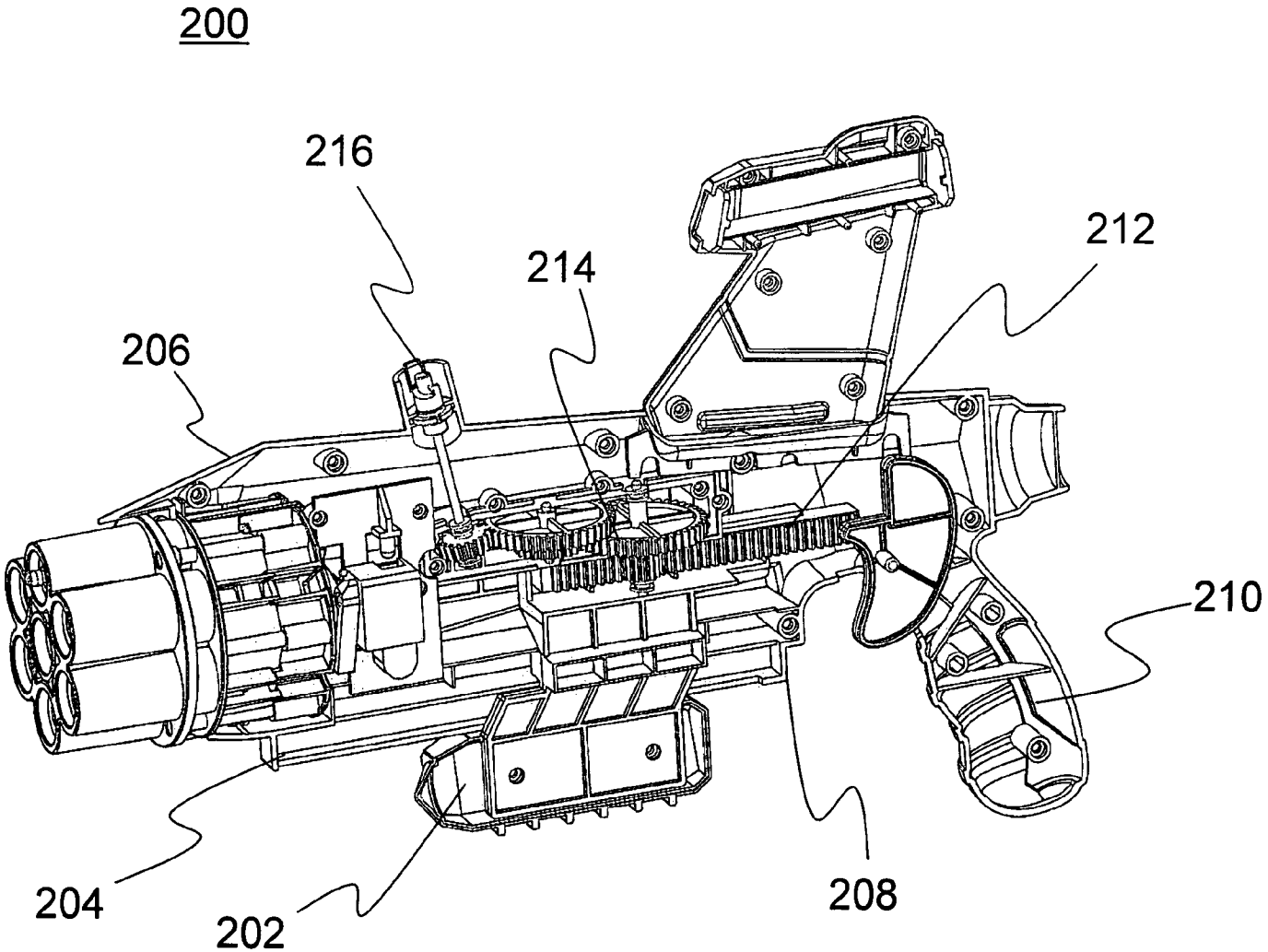
FIG. 2 is a deconstructed perspective-view illustration of the toy gun, depicting a target-launching mechanism as well as a cartridge for holding a plurality of projectiles and a firing assembly positioned to fire at least one of the plurality of projectiles upon actuation of a projectile trigger located on the gun handle.

The function of the target-launching mechanism is illustrated in more detail in the cut-away view of the toy gun 200 of FIG. 2. The target-launching trigger 202 is any suitable mechanism or device that launches the target object into the air, and in one non-limiting example, is a hand-operated slide grip that moves along the gun housing from a forward position 204 near the front barrel portion 206 to a rear position 208 near the handle 210. The target-launching trigger 202 is in direct connection with a gear rack 212 contained within the housing, such that when the target-launching trigger 202 is pulled from its forward position 204 to its rear position 208, the gear rack 212 moves in the same direction. The gear rack 212 is in a driving connection with a gear assembly 214, which in turn is in a driving connection with the target launcher 216. The gear assembly 214 is a set of rotating gears on separate axles that transmits the directional power from the target-launching trigger 202 to rotational power for the target launcher 216. When the gear rack 212 is moved by the target-launching trigger 202, the gear assembly 214 rotates, thus causing the target launcher 216 to rotate and launch the target object (not pictured).

Figure 3:
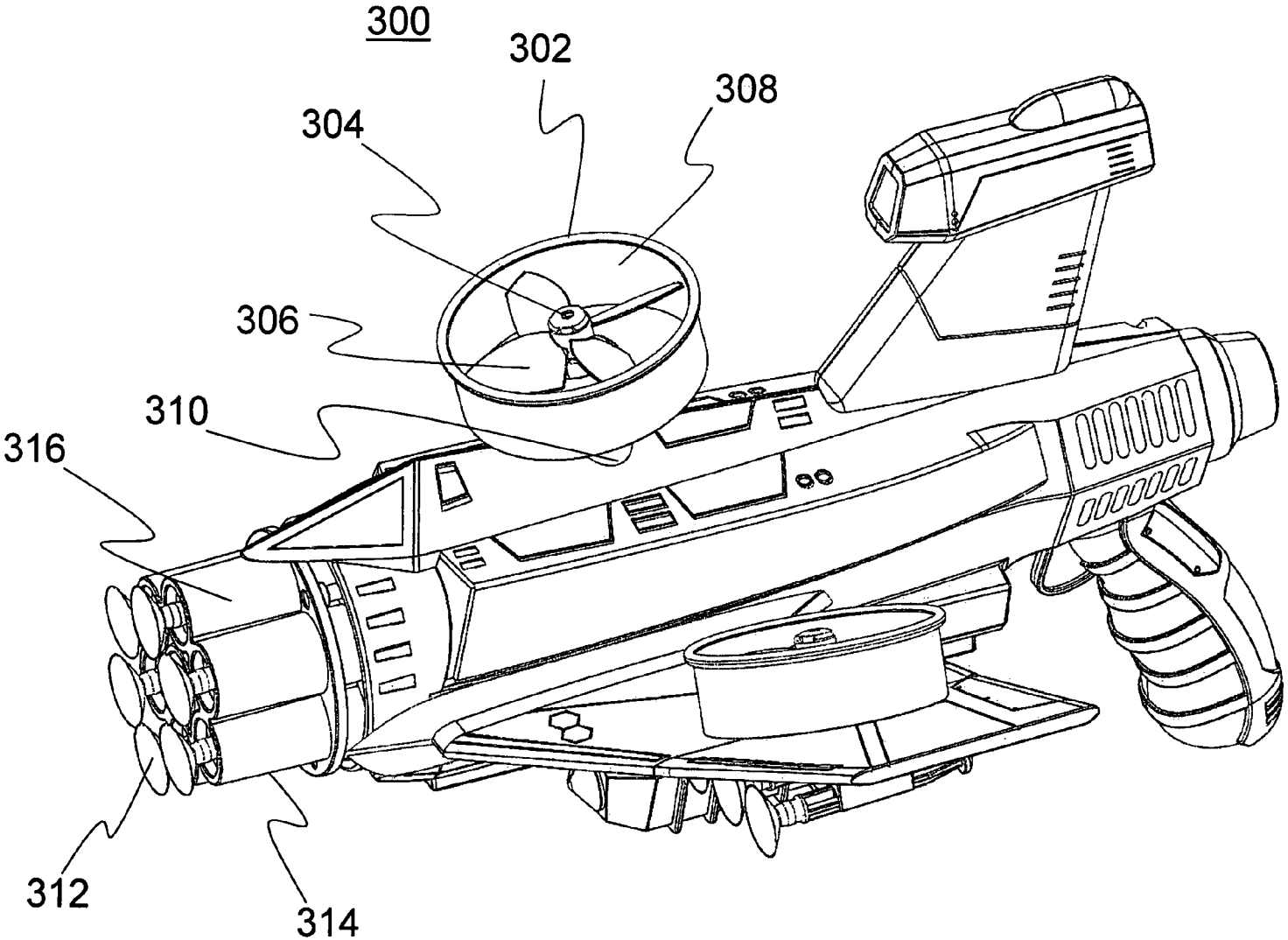
FIG. 3 is a perspective-view illustration of the toy gun, depicting a target object to be launched using the target-launching mechanism.

In one aspect, as illustrated in FIG. 3, the target object 302 is a toy propeller with a hub 304 and a plurality of blades 306 surrounded by an outer ring 308. The hub contains a connector (not shown) that is adapted to the target launcher 310 to form an interlocking connection. Once the target launcher 310 (also shown more clearly as 216 in FIG. 2) rotates the target object 302 to a certain speed, the force of the blades 306 lifts the target object 302 into the air. The target object 302 continues to rotate and generate lift for an extended period of time, during which a user can then aim toy gun 300 and fire the projectiles 312 at the target object 302. This provides a fin and challenging game that can be played with a group or alone. One skilled in the art will appreciate that several types of target objects can be used, and that even the target launching mechanism can be altered to launch different types of objects into the air for use as a target.

The cartridge of the present invention is also illustrated in FIG. 3. The cartridge 314 includes a plurality of individual barrels 316 which each contain a projectile 312. The barrels 316 are in a circular configuration to align with the firing assembly contained within the housing (not pictured). The barrels 316 retain the projectiles 312 in a forward-pointing direction until the projectiles 312 are fired. In the present aspect, there are 6 individual barrels, but one skilled in the art will appreciate that the number of barrels will vary depending on the size of the toy gun 300 and the diameter of the projectiles and barrels to be used.

Figure 4A:
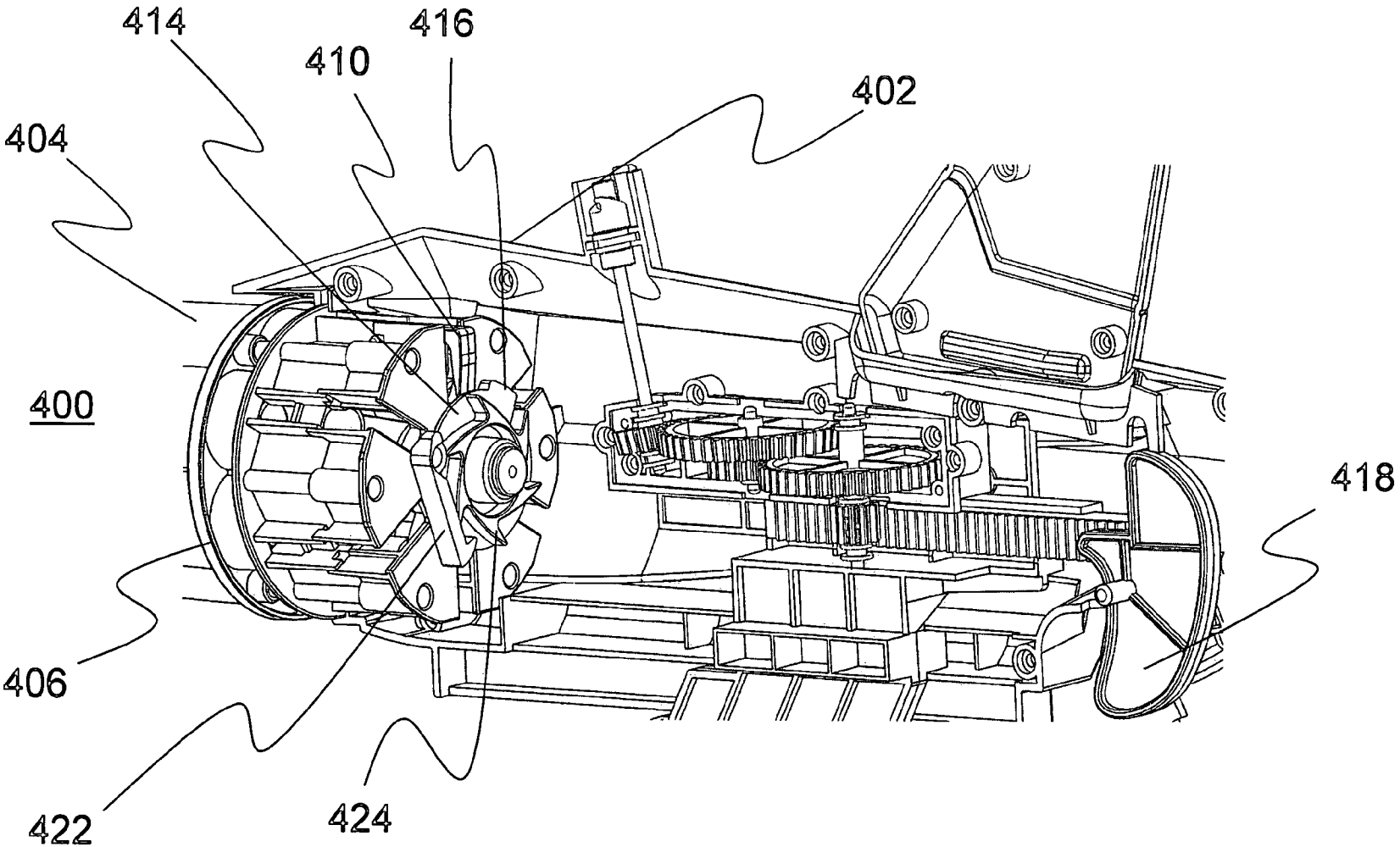
FIG. 4A is an enhanced, deconstructed perspective-view illustration depicting the firing assembly including a firing control disc, pivoting projectile lock, and firing control lock.

The firing assembly of the present invention is illustrated in FIG. 4A. The firing assembly 400 is disposed within the front barrel portion 402 of the housing and is aligned with the barrels 404 of the cartridge 406. When each projectile 408 is loaded into the cartridge, the projectile 408 is partially loaded into the firing assembly 400, where it is locked into place by a pivoting projectile lock 410, as illustrated by the deconstructed view in FIG. 4B. The pivoting projectile lock 410 also acts to restrict a spring-loaded firing member 412, which will eventually be released to propel the projectile out of the barrel 404 at a high rate of speed. The firing of a particular projectile in a particular barrel is determined by a rotating firing control disc 414, which is positioned on a non-firing end of the firing assembly 400. The firing control disc 414 also includes a firing release tab 416 that extends from a small portion of the circumference of the firing control disc 414. The firing release tab 416 is positioned such that when the firing control disc 414 is rotated, the firing release tab 416 comes into contact with the pivoting projectile lock 410 and pivots the pivoting projectile lock 410 to release both the projectile 408 and the firing member 412, thereby firing the projectile 408 out of the barrel 404 at a high rate of speed.

The firing control disc 414 is activated by the projectile trigger 418, which connects with the firing control disc 414 via a lever mechanism 420 that runs across the length of the housing. The actuation of the projectile trigger 418 rotates the firing control disc 414 which causes the aforementioned actions that fires a projectile 408 from one of the barrels 404. Once a single actuation of the projectile trigger 418 occurs, a fire control disc lock 422 interacts with a series of grooves 424 on the firing control disc 414, stopping the firing control disc 414 from rotating until the projectile trigger 418 is pulled again. After the first pull of the projectile trigger 418, the firing release tab 416 has rotated into a new position where it is ready to interact with the pivoting projectile lock 410 of the adjacent barrel 404. When the projectile trigger 418 is again pulled, the same process occurs again, firing the projectile 408 housed in the adjacent barrel 404. The process is then repeated as the firing release tab 416 rotates until it has completed a complete 360 degree revolution, firing every projectile 408 loaded into the cartridge 406. The cartridge 406 can then be reloaded, starting the entire process over again.

One skilled in the art will appreciate that the firing control disc can be redesigned with multiple firing release tabs to fire multiple projectiles with only one pull of the projectile trigger. If only a second tab is added, two projectiles will be fired at one time, and if three tabs are added, three projectiles will be fired at any one time.

Figure 4B:
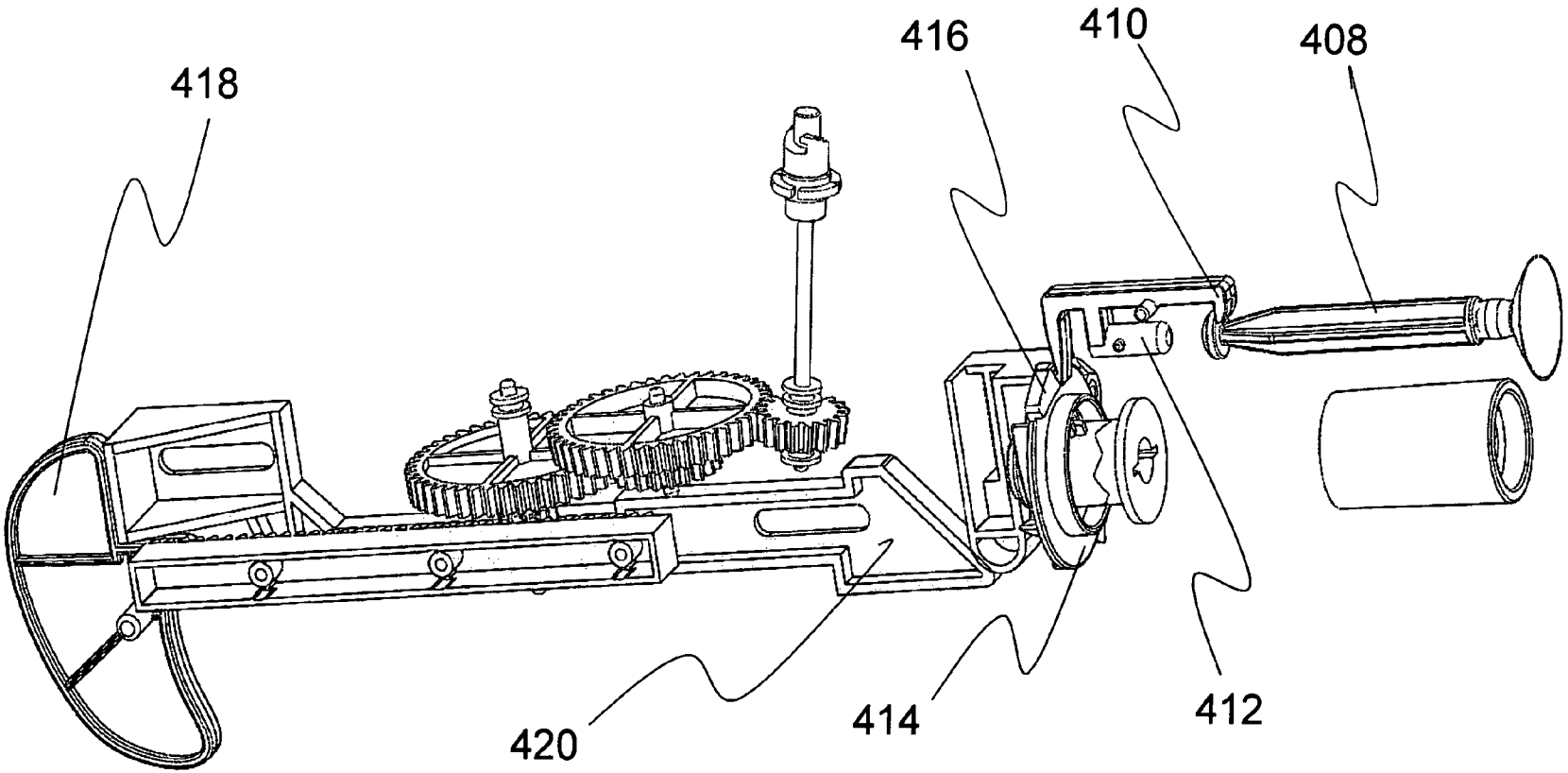
FIG. 4B is a deconstructed perspective-view illustration of the firing assembly including the firing control disc and the pivoting projectile lock in direct connection with a projectile.

In one aspect, as illustrated in FIG. 4B, the projectile is a toy dart with an elongated body and a suction cup tip that is suited for sticking to flat, smooth surfaces. However, one skilled in the art will appreciate that the projectile may be varied depending on the particular desired use. For example, a Velcro® projectile tip could be used if the target had a similar surface that would interact with Velcro®. The projectile need only be adapted to fit into the cartridge and have a particularly suited endpoint that will interact with the pivoting projectile lock of the firing assembly.

What is claimed is:

1. A multiple projectile-firing toy gun comprising:

a housing including a front barrel portion and a rear handle portion;

a firing assembly disposed within the front barrel portion of the housing to fire at least one of a plurality of projectiles upon the actuation of a projectile trigger, wherein the firing assembly further comprises a rotatable firing control disc for firing at least one of the plurality of projectiles; and a target-launching mechanism for launching a target object that acts as a moving target during the firing of the projectiles from the gun, wherein the target-launching mechanism further comprises a target-launching trigger which actuates a target launcher to launch the target object into the air, and wherein the target object is a toy propeller with a hub and a plurality of blades radially extending from the hub, and wherein the hub is adapted to the target launcher.

2. The multiple projectile-firing toy gun of claim 1, wherein the target launching mechanism further comprises a gear assembly and a gear rack, and wherein the gear assembly is in driving connection with the target launcher, and wherein the gear rack is in driving connection with the gear assembly.

3. The multiple projectile-firing toy gun of claim 2, wherein the target-launching trigger further comprises a hand-operated slide grip in driving connection with the gear rack.

4. A multiple projectile-firing toy gun comprising:

a housing including a front barrel portion and a rear handle portion; and a firing assembly disposed within the front barrel portion of the housing to fire at least one of a plurality of projectiles upon the actuation of a projectile trigger, wherein the firing assembly further comprises a rotatable firing control disc for firing at least one of the plurality of projectiles, wherein the firing assembly further comprises a spring-loaded firing member for launching the projectile out of the barrel, and wherein the firing assembly further comprises a plurality of pivoting projectile locks for locking each projectile as it is loaded into a specified barrel, and wherein the pivoting projectile locks restrict the spring-loaded firing mechanism from engaging the projectile until the actuation of the projectile trigger, wherein the firing control disc further comprises a firing release tab for pivoting the pivoting projectile lock to release the projectile and launch the spring-loaded firing member.

5. The multiple projectile-firing toy gun of claim 4, wherein the firing assembly further comprises a firing control lock for interacting with a groove in the firing control disc to permit only one projectile to be fired upon each actuation of the projectile trigger.

6. The multiple projectile-firing toy gun of claim 5, wherein the firing control disc contains a plurality of grooves that corresponds to the number of barrels in the cartridge.

7. A multiple projectile-firing toy gun comprising:

a housing including a front barrel portion and a rear handle portion; and a firing assembly disposed within the front barrel portion of the housing to fire at least one of a plurality of projectiles upon the actuation of a projectile trigger, wherein the firing assembly further comprises a rotatable firing control disc for firing at least one of the plurality of projectiles, wherein the housing further comprises a storage section for storage of projectiles and target objects, and wherein the storage section is a pair of wing-shaped protrusions extending from the housing, and wherein the wing-shaped protrusions include a mounting structure to hold a plurality of projectiles and target objects.

8. The multiple projectile-firing toy gun of claim 7, wherein the storage section is capable of holding at least 6 projectiles and 2 target objects.

9. A method of making a multiple projectile-firing toy gun, the method comprising the acts of:

forming a housing including a front barrel portion and a rear handle portion;

disposing a firing assembly within the front barrel portion of the housing to fire at least one of a plurality of projectiles upon the actuation of a projectile trigger, and further disposing a rotatable firing control disc within the housing for firing at least one of the plurality of projectiles;

disposing a target-launching mechanism within the housing for launching a target object that acts as a moving target during the firing of the projectiles from the gun;

forming a target-launching trigger which actuates a target launcher to launch the target object into the air; and forming the target object from a toy propeller with a hub and a plurality of blades radially extending from the hub, and wherein the hub is adapted to the target launcher.

10. The method of claim 9, further comprising the act of forming the target launching mechanism with a gear assembly and a gear rack, and wherein the gear assembly is in driving connection with the target launcher, and wherein the gear rack is in driving connection with the gear assembly.

11. The method of claim 10, further comprising the act of forming the target-launching trigger with a hand-operated slide grip in driving connection with the gear rack.

12. A method of making a multiple projectile-firing toy gun, the method comprising the acts of:

forming a housing including a front barrel portion and a rear handle portion;

disposing a firing assembly within the front barrel portion of the housing to fire at least one of a plurality of projectiles upon the actuation of a projectile trigger, and further disposing a rotatable firing control disc within the housing for firing at least one of the plurality of projectiles;

forming the firing assembly with a spring-loaded firing member for launching the projectile out of the barrel;

forming a plurality of pivoting projectile locks for locking each projectile as it is loaded into a specified barrel, and wherein the pivoting projectile locks restrict the spring-loaded firing mechanism from engaging the projectile until the actuation of the projectile trigger; and forming the firing control disc further with a firing release tab for pivoting the pivoting projectile lock to release the projectile and launch the spring-loaded firing member.

13. The method of claim 12, further comprising the act of interacting a fire control lock with a groove in the firing control disc to permit only one projectile to be fired upon each actuation of the projectile trigger.

14. The method of claim 13, further comprising the act of forming a plurality of grooves into the firing control disc that corresponds to the number of barrels in the cartridge.

15. A method of making a multiple projectile-firing toy gun, the method comprising the acts of:

forming a housing including a front barrel portion and a rear handle portion;

disposing a firing assembly within the front barrel portion of the housing to fire at least one of a plurality of projectiles upon the actuation of a projectile trigger, and further disposing a rotatable firing control disc within the housing for firing at least one of the plurality of projectiles; and attaching a storage section to the housing for storage of projectiles and target objects, wherein the act of attaching a storage section further comprises the act of attaching a pair of wing-shaped protrusions extending from the housing, and wherein the wing-shaped protrusions include a mounting structure to hold a plurality of projectiles and target objects.

16. The method of claim 15, further comprising the act of attaching a storage section that is capable of holding at least 6 projectiles and 2 target objects.

* * * * *